US011879218B2

(12) United States Patent
Impero et al.

(10) Patent No.: US 11,879,218 B2
(45) Date of Patent: Jan. 23, 2024

(54) ROAD SAFETY BARRIER

(71) Applicant: Pasquale Impero, Casalnuovo di Napoli (IT)

(72) Inventors: Pasquale Impero, Casalnuovo di Napoli (IT); Luigi Grassia, Lusciano (IT)

( * ) Notice: Subject to any disclaimer, the term of this patent is extended or adjusted under 35 U.S.C. 154(b) by 670 days.

(21) Appl. No.: 17/052,974

(22) PCT Filed: May 9, 2019

(86) PCT No.: PCT/IB2019/053827
§ 371 (c)(1),
(2) Date: Nov. 4, 2020

(87) PCT Pub. No.: WO2019/215661
PCT Pub. Date: Nov. 14, 2019

(65) Prior Publication Data

US 2021/0180276 A1 Jun. 17, 2021

(30) Foreign Application Priority Data

May 10, 2018 (IT) ..... 102018000005232

(51) Int. Cl.
*E01F 15/08* (2006.01)
*E01F 15/06* (2006.01)

(52) U.S. Cl.
CPC ..... *E01F 15/088* (2013.01); *E01F 15/06* (2013.01); *E01F 15/085* (2013.01); *E01F 15/086* (2013.01)

(58) Field of Classification Search
CPC ... E04H 17/16; E04H 17/1602; E04H 17/161; E04H 17/163; E04H 17/165; E01F 15/02; E01F 15/06; E01F 15/08; E01F 15/081; E01F 15/085; E01F 15/086; E01F 15/088
See application file for complete search history.

(56) References Cited

U.S. PATENT DOCUMENTS 6,138,993 A * 10/2000 Mitchell, Jr. ..... F24F 1/58 256/25
7,866,635 B2 * 1/2011 Payne ..... E04H 17/168 256/24
10,221,529 B1 * 3/2019 Sanders ..... H02G 3/386
(Continued)

FOREIGN PATENT DOCUMENTS

CA 2276279 A1 * 2/2000 ..... E04H 17/1413
CA 2493003 A1 * 7/2006 ..... E04H 17/16
(Continued)

*Primary Examiner* — Jonathan P Masinick
(74) *Attorney, Agent, or Firm* — Endurance Law Group PLC

(57) ABSTRACT

A road safety barrier has a plurality of panels flanking one another at respective vertical lateral edges thereof, made of a material deformable upon impact by a vehicle, and a plurality of vertical support elements supporting the panels. The vertical support elements include a first and a second vertical support member facing one another at the flanked vertical lateral edges of the panels, on opposite sides with respect to two major faces of the panels. The barrier has components for reciprocally blocking the first and the second vertical support member to the two opposite faces of the panels, and longitudinal stiffening elements coupled to the panels at respective upper longitudinal edges thereof.

14 Claims, 13 Drawing Sheets

(56) References Cited

U.S. PATENT DOCUMENTS

| | | | | |
|---|---|---|---|---|
| 10,676,958 | B2 * | 6/2020 | Short | E04H 17/143 |
| 10,689,879 | B2 * | 6/2020 | Messelis | F41H 5/013 |
| 2002/0125467 | A1 * | 9/2002 | Erwin | E04H 17/16 256/1 |
| 2008/0011993 | A1 * | 1/2008 | Sadinsky | E04H 17/161 256/25 |
| 2009/0321701 | A1 * | 12/2009 | Payne | E04H 17/161 256/57 |
| 2015/0041742 | A1 * | 2/2015 | Xu | E04H 17/161 256/24 |

FOREIGN PATENT DOCUMENTS

| | | | | |
|---|---|---|---|---|
| DE | 4335904 | A1 | 10/1993 | |
| EP | 2520718 | A2 | 3/2012 | |
| EP | 2520718 | A2 * | 11/2012 | E01F 15/085 |
| EP | 3587670 | A1 * | 1/2020 | E01F 15/006 |
| FR | 2546932 | A1 | 6/1983 | |
| FR | 2781510 | A1 | 7/1998 | |
| KR | 200441706 | Y1 * | 9/2008 | |
| KR | 100946096 | B1 * | 3/2010 | |
| KR | 20130000286 | U * | 1/2013 | |

* cited by examiner

ROAD SAFETY BARRIER

FIELD OF THE INVENTION

The present invention relates to the technical sector relating to road safety systems used as passive containing elements for keeping vehicles within the road and/or carriageway, which vehicles, incidentally or for unforeseen causes, have skidded or departed from their normal trajectory, in this way preventing the vehicles from invading the opposite carriageway or even exiting the carriageway.

In particular, the present invention concerns a road safety barrier.

DESCRIPTION OF THE PRIOR ART

A first type of road barrier at present known is the one commonly known by the term "guardrails".

Guardrails comprise a series of uprights lodged in the ground, at a certain distance from one another and by the side of each of the edges of the carriageway, and a series of undulated bands which are fixed to the uprights so as to be consecutive to one another, and then reciprocally fixed to one another to form a continuous front and constitute a safety barrier.

The undulated bands are made of a metal material, such as for example galvanised steel, and are designed so as to absorb, by deforming, an eventual impact caused by a vehicle that strikes against a guardrail due to a skid.

This type of safety barrier, however, presents some drawbacks.

In fact, the undulations present in the bands form and constitute projecting and discontinuous elements for the barrier.

The presence of these discontinuities, in particular of the projecting parts of the undulations, can oppose the longitudinal motion of the vehicles impacting against the guardrail, with a consequent increase of the deceleration of the vehicles.

This leads to an increase in the stresses acting on the vehicles following the impact and therefore leads to a greater probability of deformation of the bodywork and the mechanical parts of the vehicle; these circumstances considerably increase the risks of lesions and injury to the driver.

Further, the projecting parts of the undulations of the guardrail are very dangerous for motor cyclists.

A further type of road safety barrier used at present, for example to divide the lanes of a carriageway, is constituted by blocks of concrete arranged consecutively and continuously, directly on the road surface.

These barriers, of known type and termed "New Jersey", have no significant discontinuities or projecting parts, but obviously they are highly rigid as they are not able to deform to absorb the impact of an eventual impact.

In a case of an impact against the New Jersey barrier, therefore, the risks of damage and injury for both driver and vehicle are very high.

SUMMARY OF THE INVENTION

The aim of the present invention is therefore to provide a new road safety barrier that is able to obviate the above-mentioned drawbacks present in the gripping devices of known type.

In particular, the aim of the present invention is therefore to provide a new road safety barrier that does not have projecting or discontinuous elements or parts but which is however able to absorb, by deforming, the kinetic energy generated by an impact of a vehicle.

The above-cited aims are obtained by a road safety barrier according to claim 1.

Further characteristics and advantageous aspects of the road safety barrier of the present invention are set down in the various claims dependent on claim 1.

BRIEF DESCRIPTION OF THE DRAWINGS

Preferred, but not exclusive, embodiments of the road safety barrier of the present invention will be described in the following with reference to the appended tables of drawings, in which:

FIG. 6A illustrates a view from below, while

FIG. 12A illustrates a view from below, while

DESCRIPTION OF THE PREFERRED EMBODIMENTS

Figure 1:
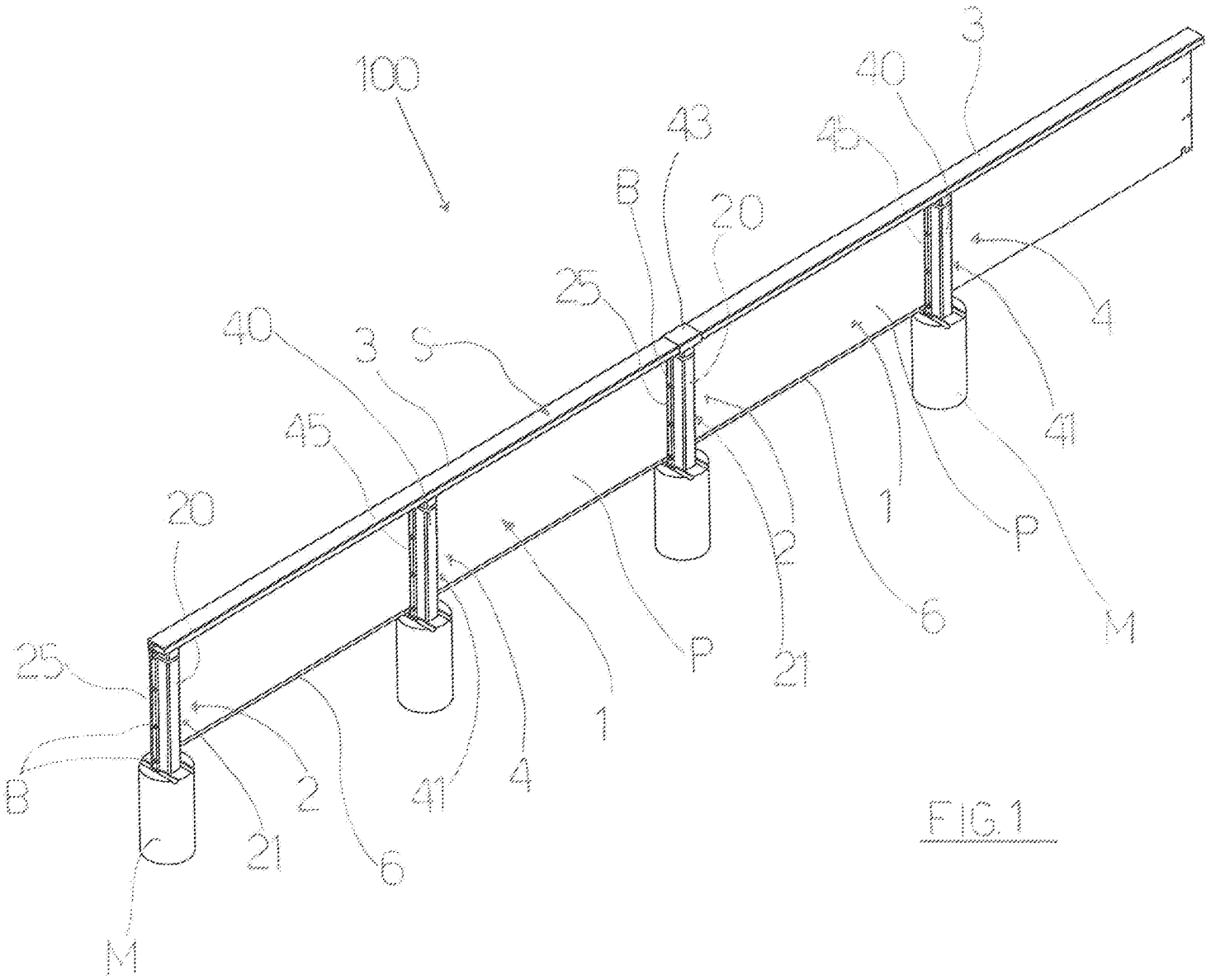
FIG. 1 is a schematic perspective view of the road safety barrier of the present invention, in a preferred embodiment thereof.

With reference to the accompanying tables of drawings, reference numeral (100) denotes the road safety barrier of the present invention, in its entirety and in the various embodiments.

The road safety barrier (100) comprises a plurality of containing elements (1) for absorbing an impact by a vehicle, and a plurality of vertical support elements (2) for bearing the plurality of containing elements (1).

A first peculiarity of the barrier (100) of the invention consists in the fact that the containing elements (1) are constituted by panels (P) arranged flanked to one another at relative vertical lateral edges in such a way that the relative two faces form relative continuous flat surfaces.

Each of the panels (P) is made of a material that is deformable consequent upon an impact by a vehicle, so as to absorb kinetic energy generated by the impact.

A further peculiarity of the barrier (100) consists in the fact that each of the vertical support elements (2) comprises a first vertical support member (21) and a second vertical support member (22) arranged facing one another at the flanked vertical lateral edges of the panels (P), on opposite sides with respect to the two faces of the panels (P).

In particular, the first vertical support member (21) and the second vertical support member (22) of each of the vertical support elements (2) are conformed in such a way as to have flat portions (25) for coupling with the faces of the panels (P) and with at least one from between the first vertical support member (21) and the second vertical support member (22) being conformed in such a way as to have a main portion (20) having a cavity along the relative vertical extension.

Further, the barrier (100) comprises blocking means (B) (for example, screws, rivets and bolts or the like), conformed for crossing the panels (P) and the flat portions (25) of the first vertical support member (21) and the second vertical support member (22), for the reciprocal blocking of the first vertical support member (21) and the second vertical support member (22) of each of the vertical support elements (2) to the two opposite faces of the panels (P) at the relative vertical lateral edges, and longitudinal stiffening elements (3) which are coupled to the panels (P) at the relative upper longitudinal edges.

The blocking means (B) can also comprise plates, for example rectangular (FIGS. 2, 3, 4, 8, 9) or L-shaped (FIG. 13) which can be interposed between the panels (P) and the flat portions (25) of the two vertical support members (21, 22) when they are coupled to the panels (P) for the reciprocal fixing and blocking.

The accompanying figures include illustrations of possible embodiments of the barrier (100) that are objects of the invention, in which for the sake of simplicity only two panels (P) are illustrated, flanked and coupled: it is clear that the barrier (100) is not limited to this particular number of panels.

Owing to this peculiarity, the barrier (100) has impact containing elements (the panels) which have a completely flat impact surface, and therefore free of projections and discontinuities, and further, these containing elements are made of a material that is deformable following an impact and are thus able to absorb the kinetic energy of the vehicle which impacts against the barrier.

Further, the special conformation of the vertical support elements, in which at least one from between the two vertical support members of which they are composed is conformed in such a way as to have a main portion having a cavity (for example as it is drawn), together with the presence of the longitudinal stiffening elements coupled to the upper longitudinal edges of the panels, enables giving the barrier a rigidity that is such as to contain or limit the deformation thereof as a consequence of an impact.

This rigidity is advantageously given without having to have recourse to predisposing projections or undulations, as in the case of the undulated bands of the prior-art guardrails.

In particular, the two vertical support members constituting the vertical support elements are applied at the contact points between the vertical edges of two consecutive panels, reinforcing them against a possible separation thereof and de-alignment as a consequence of the forces generated consequent upon an impact.

At the same time the longitudinal stiffening elements, applied and coupled to the upper longitudinal edges of the panels, enable increasing the flexional rigidity of the barrier against the stresses that occur as a consequence of an impact.

Other particularly advantageous characteristics of the road safety barrier (100) of the invention, for the purposes of an increase of the relative rigidity, are set out in the following.

Figure 4:
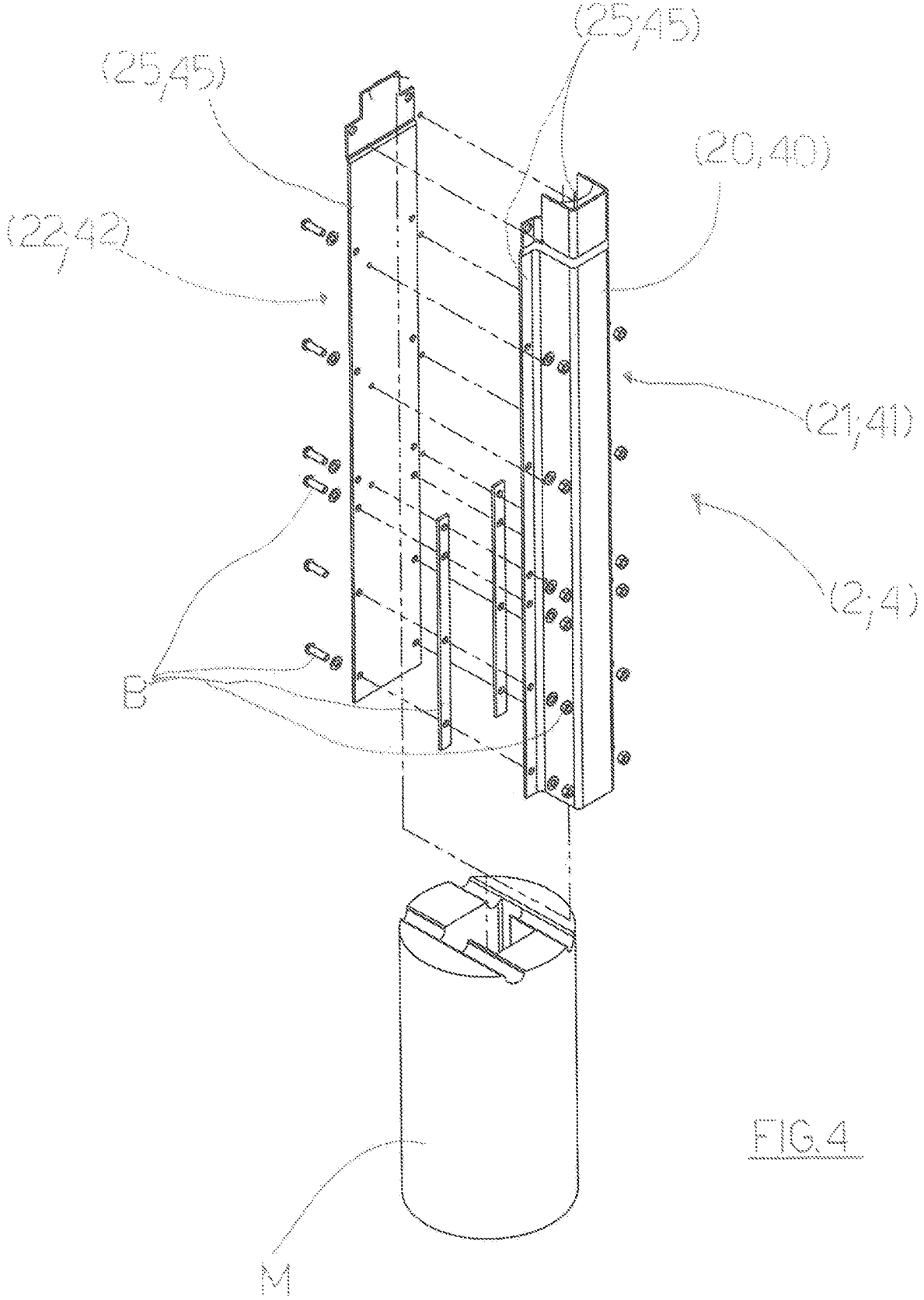
FIG. 4 illustrates particularly significant components of the road safety barrier of the invention, utilisable both for the assembly of the preferred embodiment of FIG. 1 and for the preferred embodiment of FIG. 3.
Figure 5:
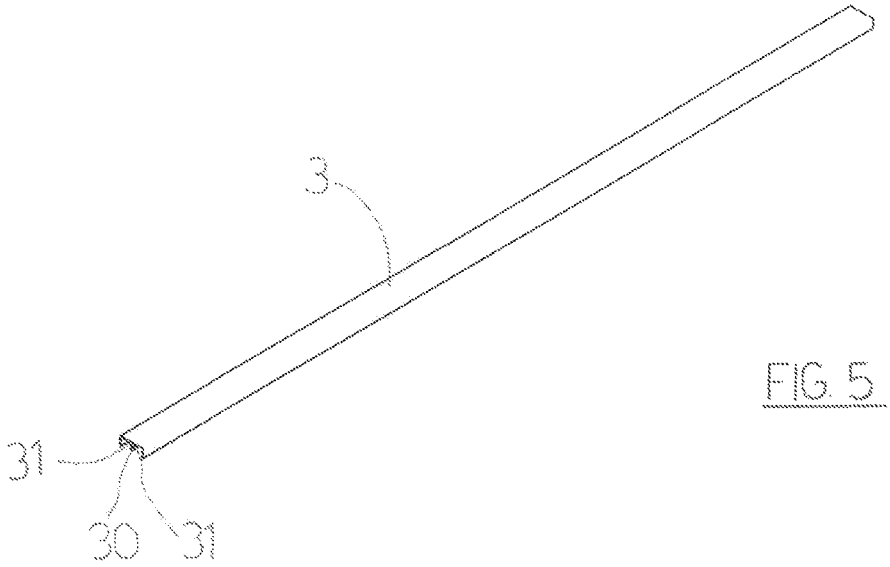
FIG. 5 illustrates a particularly significant component of the road safety barrier of the invention, utilisable both for the assembly of the preferred embodiment of FIG. 1 and for the preferred embodiment of FIG. 3.
Figure 6A:
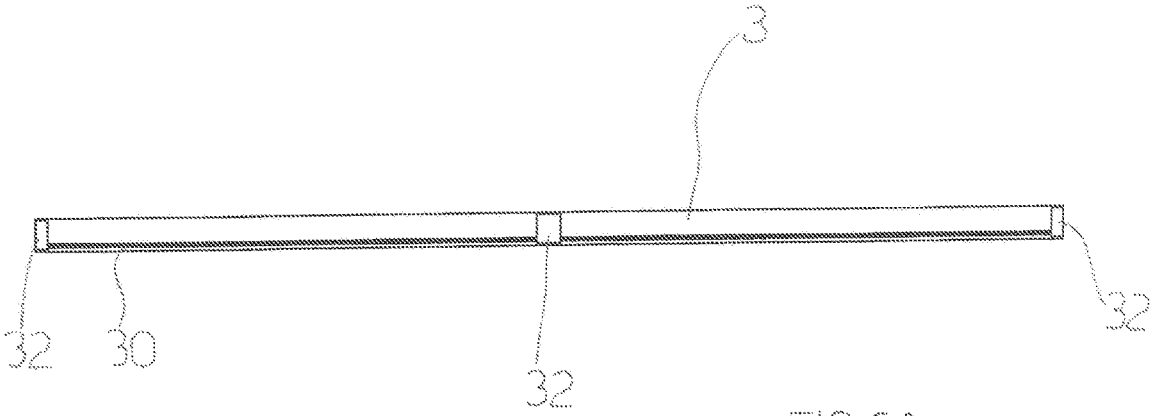
Figure 6B:
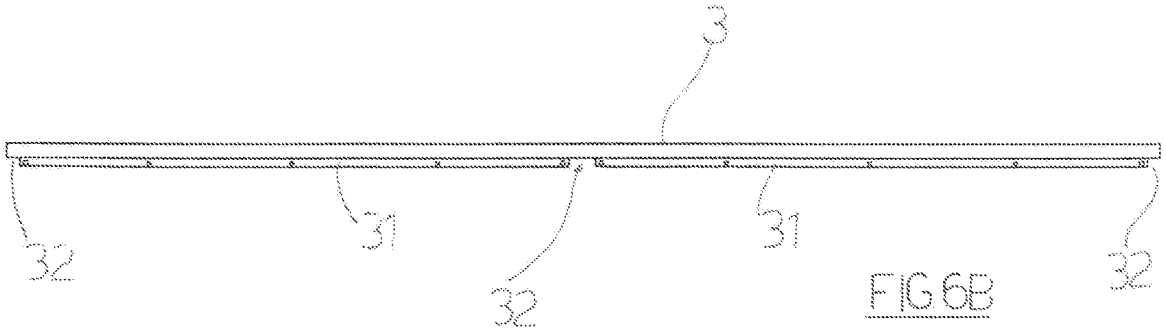
FIG. 6B illustrates a lateral view of the component of FIG. 5.
Figure 10:
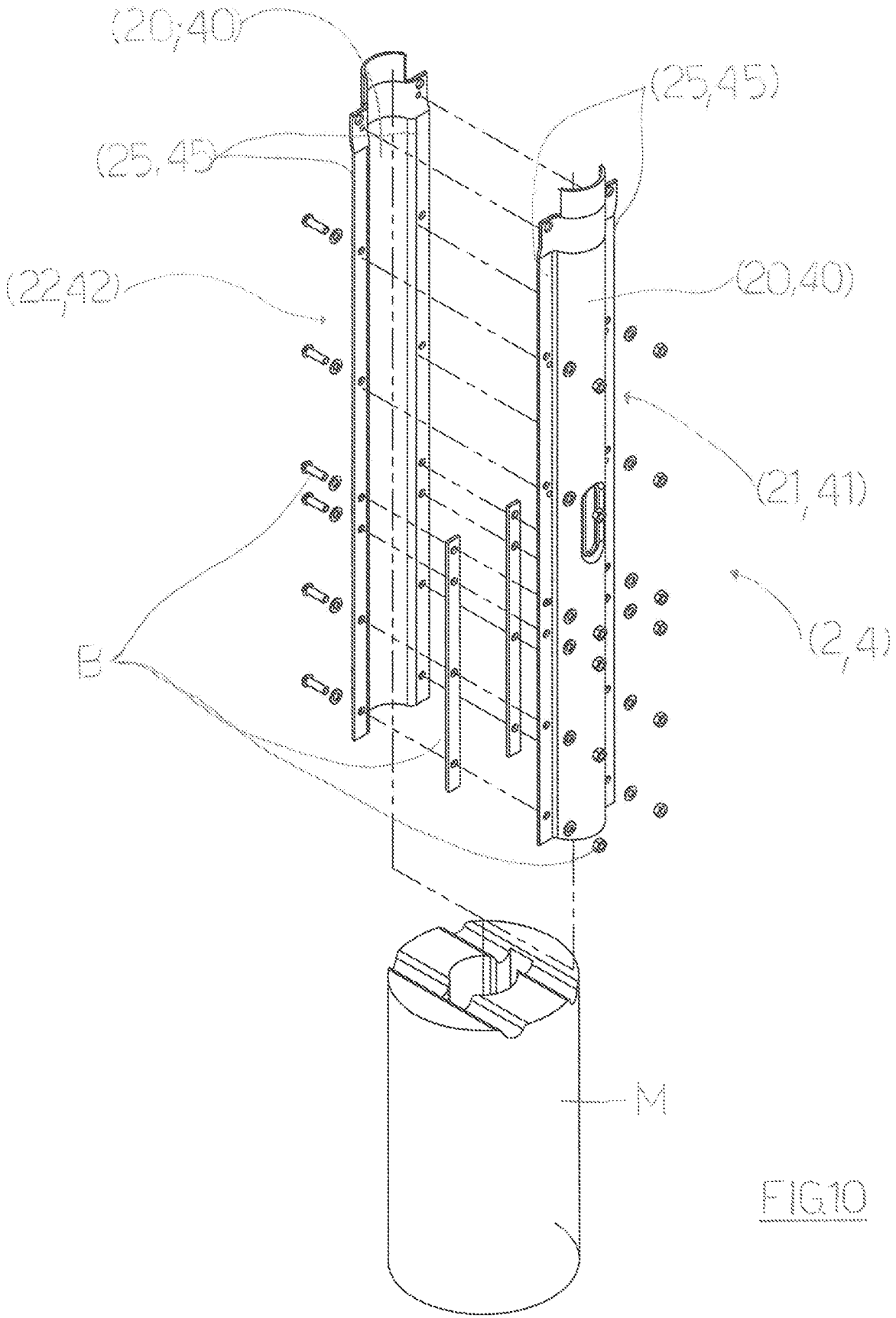
FIG. 10 illustrates particularly significant components of the road safety barrier of the invention, utilisable both for the assembly of the third preferred embodiment of FIG. 7 and for the fourth preferred embodiment of FIG. 9.
Figure 11:
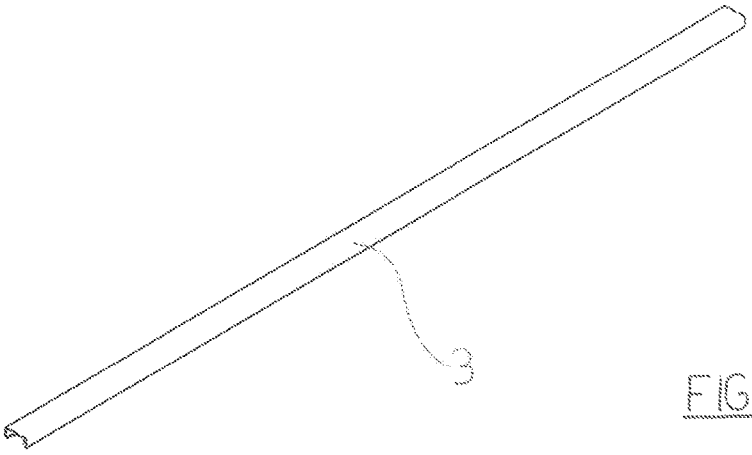
FIG. 11 illustrates a particularly significant component of the road safety barrier of the invention, utilisable both for the third preferred embodiment of FIG. 7 and for the preferred embodiment of FIG. 9.
Figure 12A:
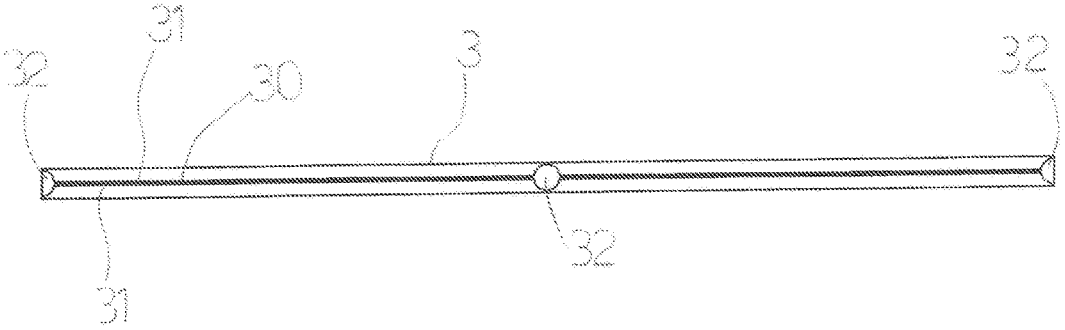
Figure 12B:
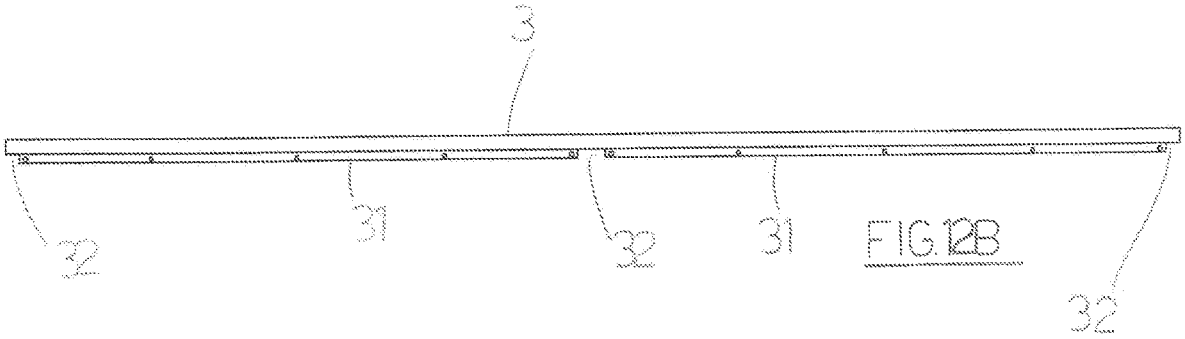
FIG. 12B illustrates a lateral view of the component of FIG. 11.

The main portion (20) of the first vertical support member (21) and/or of the second vertical support member (22) is conformed so as to have a quadrangular, square or rectangular, transversal section shape or a semi-circular transversal section shape so as to identify a cavity internally thereof which extends along the relative vertical extension (see for example FIGS. 4 and 10).

The barrier (100) can further comprise vertical supplementary support elements (4) which are coupled to the panels (P), in an intermediate position between two vertical support elements (2).

The possible presence of vertical supplementary support elements (4) enables increasing the flexional rigidity of the barrier against the stresses generated on the panels following an impact.

In particular, correspondingly with the vertical support elements (2), the vertical supplementary support elements (4) comprise a first vertical supplementary support member (41) and a second vertical supplementary support member (42) arranged facing one another, on opposite sides with respect to the two faces of the panels (P).

The first vertical supplementary support member (41) and the second vertical supplementary support member (42) of each of the vertical supplementary support elements (4) are conformed in such a way as to have flat portions (45) for coupling with the faces of the panels (P) and with at least one from between the first vertical supplementary support member (41) and the second vertical supplementary support member (42) being conformed in such a way as to have a main portion (40) having a cavity along the relative vertical extension.

The longitudinal stiffening elements (3) have a shape such as to have a longitudinal groove (30) having a shape and dimensions such as to be able to accommodate internally thereof a portion of the upper longitudinal edge of the panels (P) and enable coupling thereof to the panels (P).

In particular, the longitudinal stiffening elements (3) have a shape that is such as to exhibit a pair of longitudinal walls (31) identifying between them the longitudinal groove (30)

arranged at a reciprocal distance in such a way that they are destined to contact portions of the two faces of the panels (P) when the longitudinal stiffening elements (3) are coupled to the upper longitudinal edges of the panels (P) by means of the relative longitudinal grooves (30) (see for example FIGS. 5, 6A, 6B, 11, 12A, 12B).

Fastening means (F) (for example rivets and bolts and the like) are also provided to cross the longitudinal walls (31) of the longitudinal stiffening elements (3) and the panels (P) for blocking the longitudinal stiffening elements (3) to the panels (P).

The longitudinal stiffening elements (3) are advantageously coupled to the panels (P) at the upper longitudinal edges of the panels (P) consecutively and flanked to one another to form an upper continuous stiffening strip (S) for the road barrier, in practice constituting a sort of upper frame for the barrier.

In this matter, the stiffening elements (3) comprise, in the lower part thereof, special seats or housings (32) having adequate shape and dimensions for internally receiving the upper ends of the first member (21) and the second member (22) of the vertical support elements (2), as well as for receiving the upper ends of the first member (41) and the second member (42) of the vertical supplementary support elements (4).

The barrier (100) further comprises connecting joints (43) that are couplable and fixable at flanking points between the longitudinal stiffening elements (3).

For example, in the embodiments illustrated in FIGS. 1, 2, 3, 7, 8, 9, the connecting joints (43) are conformed in such a way as to be positioned and fixed superiorly to the longitudinal stiffening elements (3), at the flanking points thereof.

Figure 13:
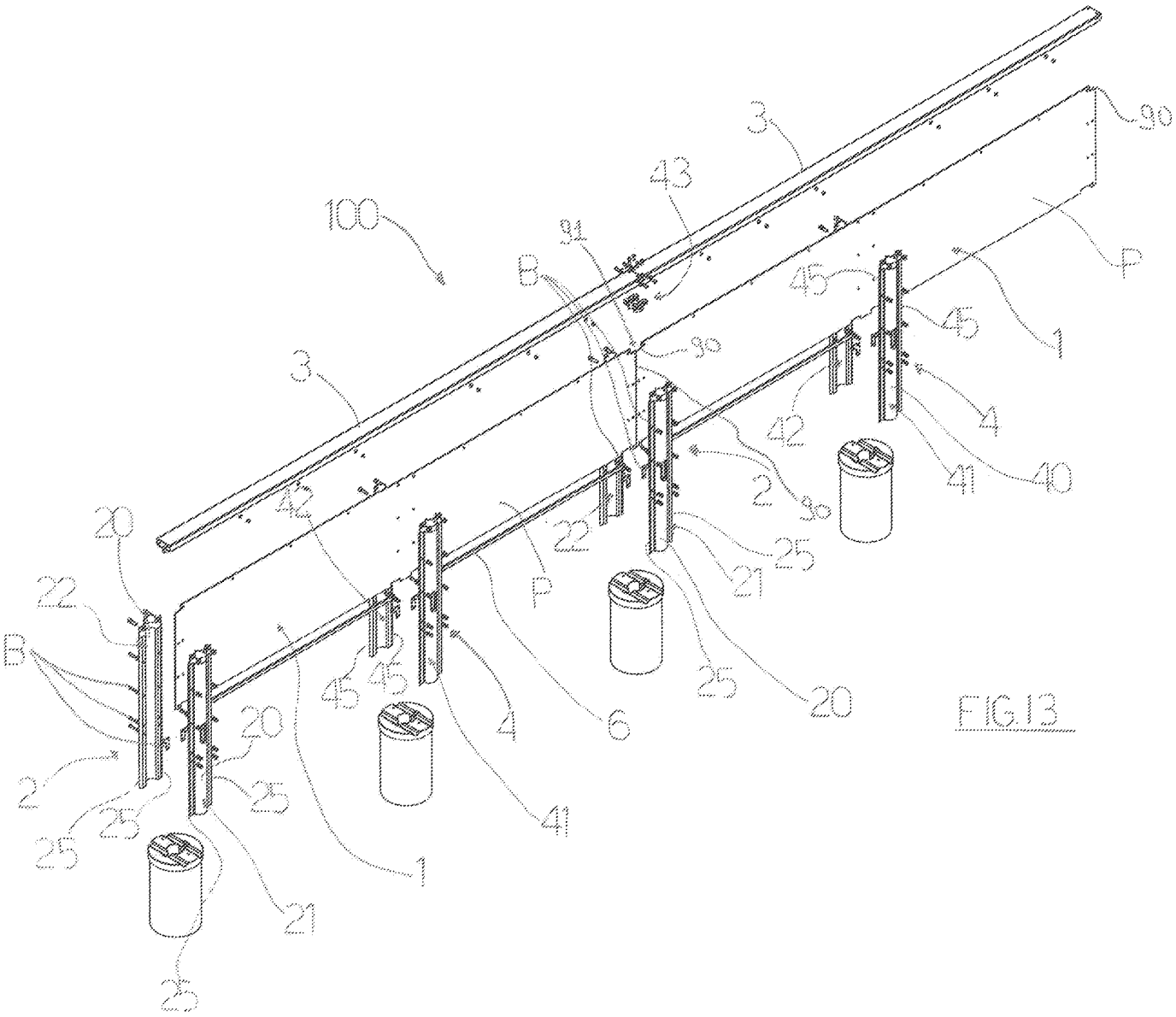
FIG. 13 is a schematic perspective view, exploded to evidence the various components thereof, of a possible other preferred embodiment of the road safety barrier of the invention.

In a special and advantageous embodiment illustrated in FIG. 13, the connecting joints (43) can instead have a shape that is such as to enable them to be positioned between the stiffening elements (3) and the panels (P). In this case the panels (P) are conformed in such a way as to have a recess (90), in the upper part thereof and in proximity of the vertical flanking sides thereof to the adjacent panels (P).

In this way, when two panels (P) are flanked to one another, the two relative recesses (90) form a seat (91) for the positioning of the connecting joint (43), which in turn will insert in the seat or housing (32) present in the lower part of the longitudinal stiffening elements (3).

In this special embodiment, therefore, the barrier (100) does not have any projecting part above the longitudinal stiffening elements (3).

Figure 3:
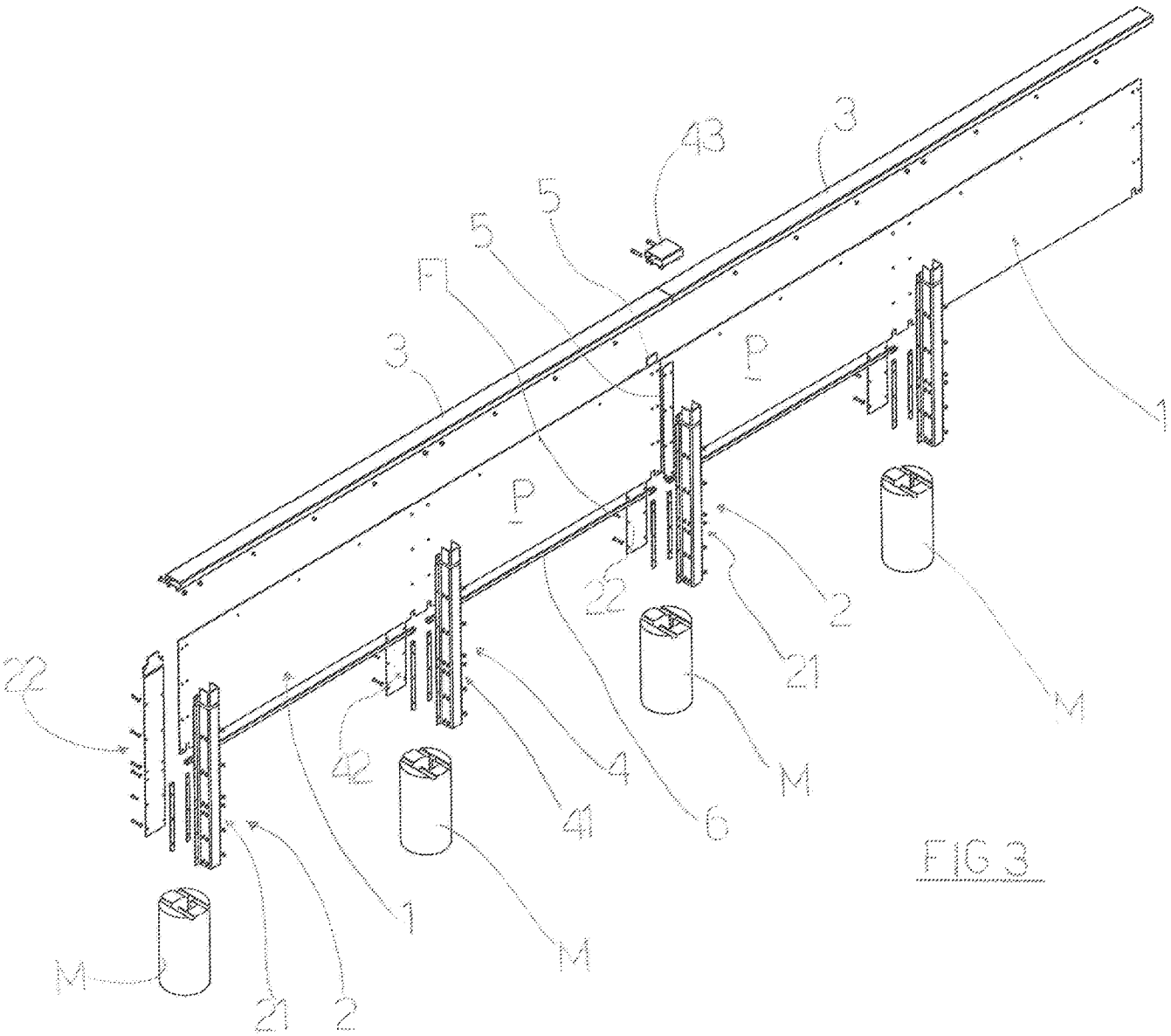
FIG. 3 is a schematic perspective view of the road safety barrier, exploded to evidence the various components thereof, in a possible other preferred embodiment of the road safety barrier of the invention.
Figure 9:
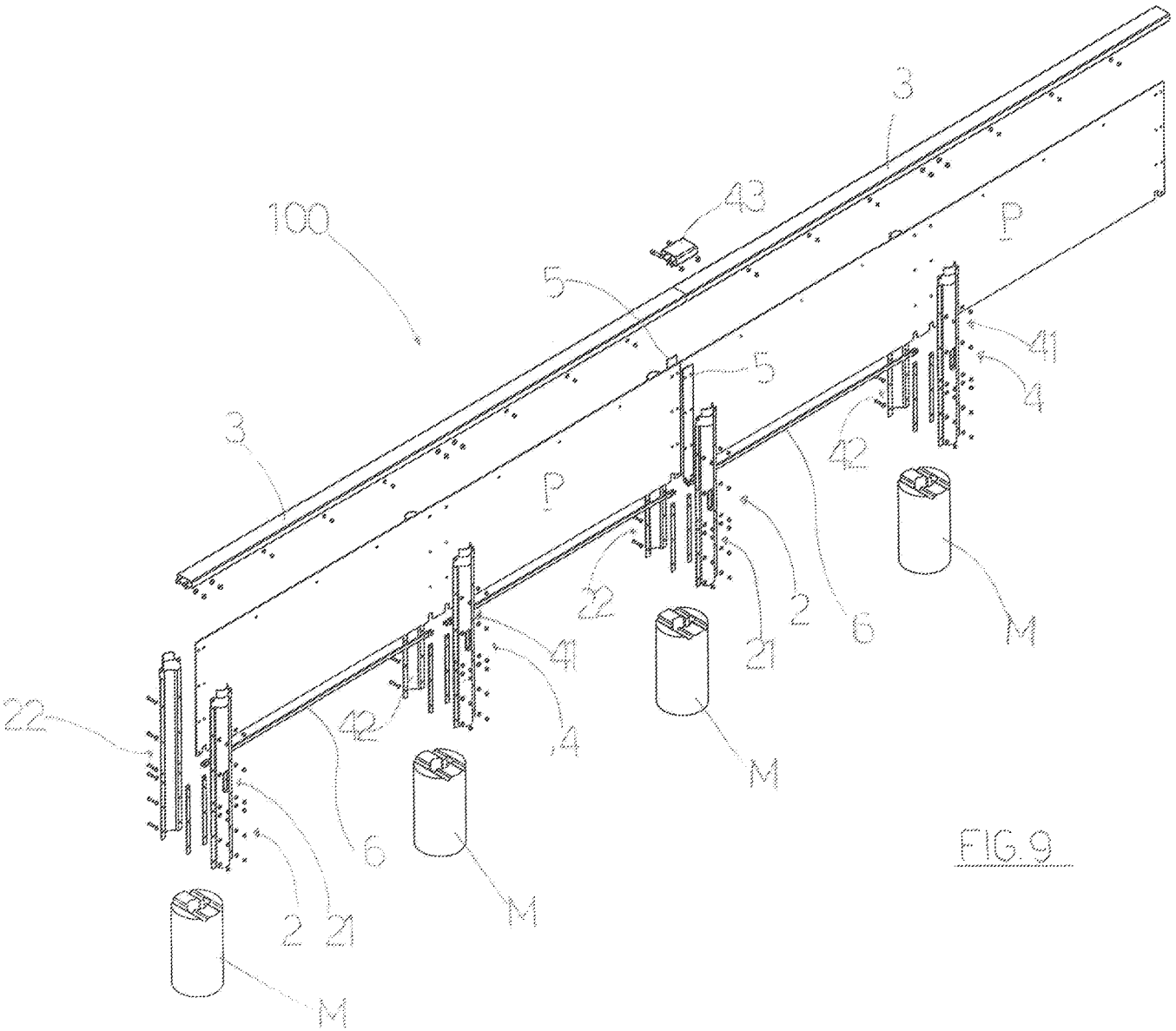
FIG. 9 is a schematic perspective view of the road safety barrier, exploded to evidence the various components thereof, in a possible fourth other preferred embodiment of the road safety barrier of the invention.

With the aim of further increasing the characteristics of rigidity, in particular in the connecting points between the various panels, while maintaining the capacity to absorb impacts due to the deformability of the panels, the barrier (100) can comprise vertical stiffening elements (5), for example constituted by slabs, which are arranged and coupled to the panels (P) at the relative vertical edges flanked to one another, in such a way as to be interposed between the faces of the panels (P) and the first and second vertical support members (21, 22) of the vertical support elements (2) (see for example FIGS. 3 and 9).

Further, the barrier (100) can also comprise longitudinal reinforcing elements (6) couplable to the panels (P) along the relative lower longitudinal edges.

The longitudinal reinforcing elements (6) have a shape such as to exhibit a longitudinal groove (60) having a shape and dimensions such as to be coupled to the lower longitudinal edge of the panels (P) and a pair of longitudinal tabs (61) identifying between them the longitudinal groove (60) and arranged at a reciprocal distance such that they are destined to contact portions of the two faces of the panels (P) when the longitudinal reinforcing elements (6) are coupled to the lower longitudinal edges of the panels (P) by means of the relative longitudinal grooves (60).

Fastening means (F1) (for example rivets and bolts and the like) are provided having a shape such as to cross the longitudinal tabs (61) of the longitudinal reinforcing elements (6) and the panels (P) for blocking the longitudinal reinforcing elements (6) to the panels (P).

In substance, in this way each panel (P) constituting the barrier (100) is framed at all the relative edges, whether vertical lateral or upper and lower, thus having a flexional rigidity that is sufficient to enable the panel to deform as a consequence of an impact, but at the same time to contain even heavier vehicles, such as buses or juggernauts.

Further, the panels (P) are made of a ductile material which enables the panels (P) to deform without reaching the breaking point thereof.

For example, the panels (P) can be made of a plastically-deformable thermoplastic material, preferably PET or polycarbonate, or made of a ductile metal material, preferably aluminium or steel.

The panels (P) can, for example, be realised with the following dimensions: height of about 0.6-1 metre, length of about 2-6 metres, and a thickness of about 6-12 mm.

The various elements and components making up the frame of the panels (P), i.e. the vertical support elements (2), the longitudinal stiffening elements (3), the vertical supplementary support elements (4), the vertical stiffening elements (5), the longitudinal reinforcing elements (6) are made of a metal material, preferably aluminium or steel.

Figure 2:
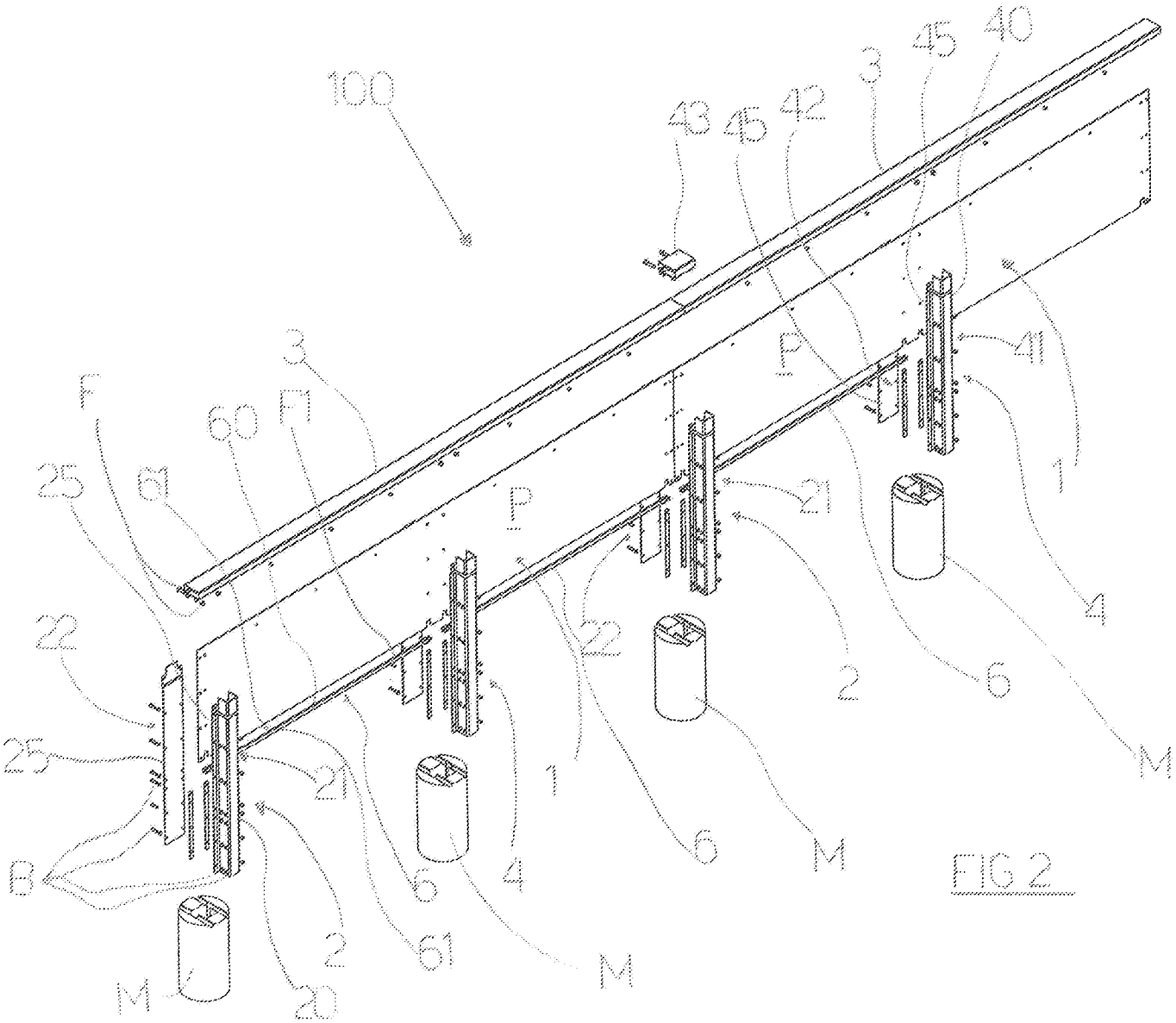
FIG. 2 is a schematic perspective view of the road safety barrier of FIG. 1, exploded to evidence the various components thereof.

FIGS. 1 and 2 illustrate a first possible embodiment of the barrier (100) in which the first vertical support element (21) of the vertical support elements (2) has a main portion (20) with a transversal section that is quadrangular, in particular square, while the second vertical support element (22) is singly constituted by a flat portion (25) such as a flat slab. In this embodiment the vertical support elements (2) are coupled and fixed to the panels (P) without the interposing of the vertical stiffening elements (5).

FIG. 3 illustrates a second possible embodiment of the barrier (100) in which the vertical support elements (2) have the same shape and structure as those of FIGS. 2 and 3 but are mounted and coupled to the panels by the interposing of the vertical stiffening elements (5).

In the two embodiments illustrated in figures from 1 to 3, the barrier (100) further comprises the vertical supplementary support elements (4), in which the relative first vertical supplementary support members (41) have a main portion with a quadrangular transversal section quadrangular, for example square, while the second supplementary vertical support members (42) are only constituted by a flat portion such as a flat slab.

FIG. 4 illustrates, in an exploded view, the structure both of a vertical support element (2) and a supplementary vertical support element (4) used in both embodiments of figures from 1 to 3.

Figure 7:
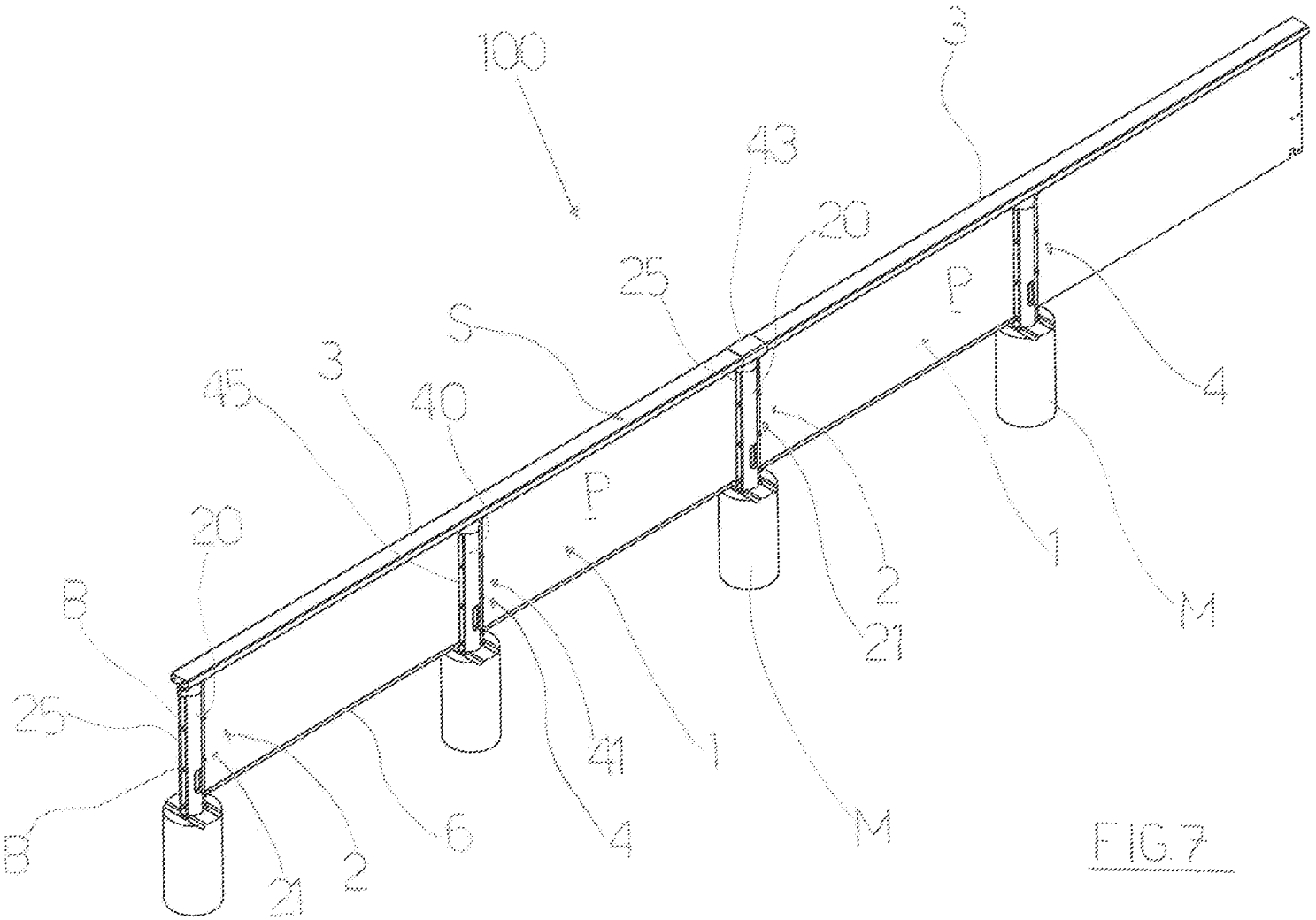
FIG. 7 is a schematic perspective view of the road safety barrier of the present invention, in a third possible preferred embodiment thereof.
Figure 8:
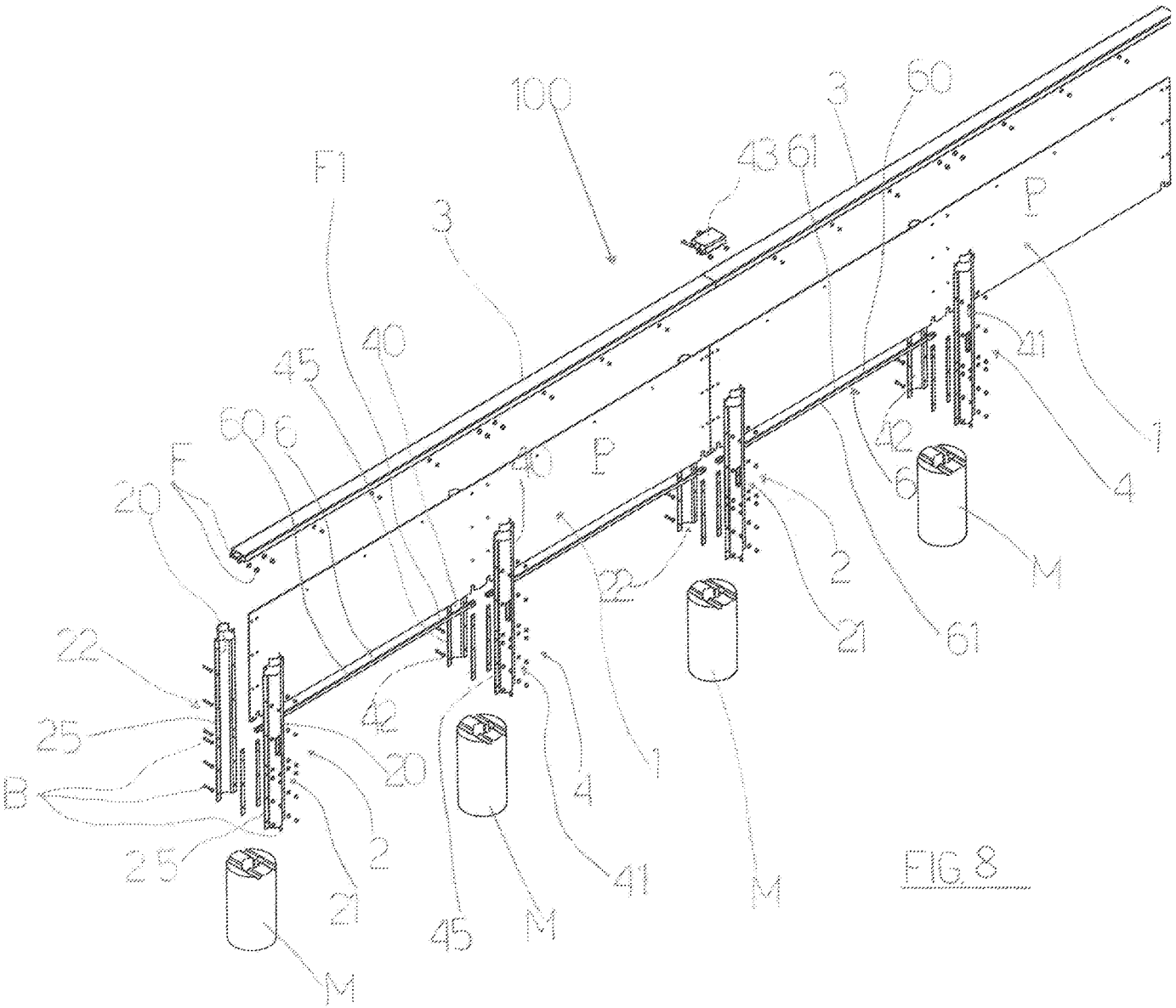
FIG. 8 is a schematic perspective view of the road safety barrier of FIG. 7, exploded to evidence the various components thereof.

FIGS. 7 and 8 illustrate a third possible embodiment of the barrier (100) in which the first vertical support element (21) of the vertical support elements (2) has a main portion (20) with a transversal section that is semi-circular, and in which the second vertical support element (22) has a main portion (20) with a transversal section that is semi-circular. In this embodiment the vertical support elements (2) are coupled and fixed to the panels (P) without the interposing of the vertical stiffening elements (5).

FIG. 9 illustrates a fourth possible embodiment of the barrier (100) in which the vertical support elements (2) have the same shape and structure as those of FIGS. 7 and 8 but are mounted and coupled to the panels by the interposing of the vertical stiffening elements (5).

In the two embodiments illustrated in figures from 7 to 9, the barrier (100) further comprises the vertical supplementary support elements (4), in which the relative first vertical supplementary support members (41) that the relative second supplementary vertical support members (42) have a main portion with a transversal section that is semi-circular.

FIG. 10 illustrates, in an exploded view, the structure both of a vertical support element (2) and a supplementary vertical support element (4) used in both embodiments of figures from 7 to 9.

In the various embodiments illustrated in the figures, the vertical support elements (2) and the vertical supplementary support elements are lodgeable in the ground using concrete sleeves (M), which are superiorly provided with special seats having a correct shape for couplingly receiving the lower ends of the vertical support elements (2) and also the vertical supplementary support elements (4).

Figure 14B:
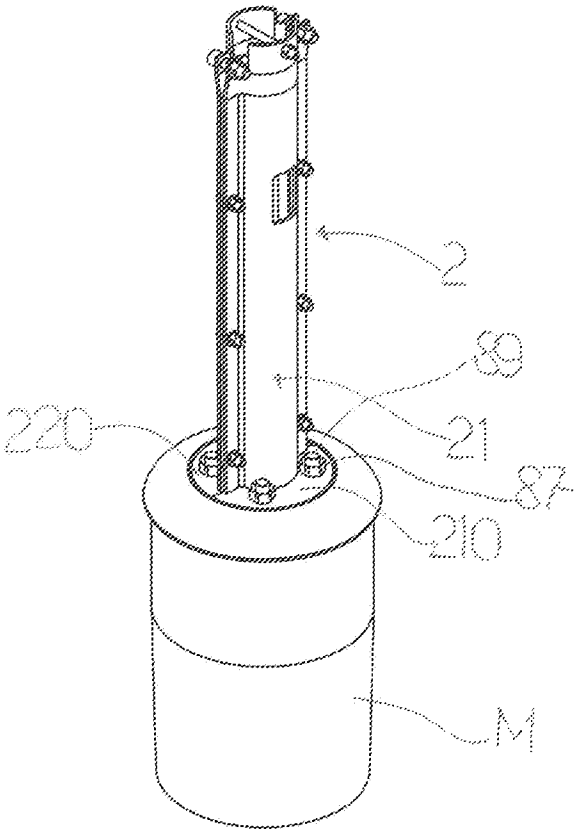
FIG. 14B illustrates the components of FIG. 14A in an assembled configuration.
Figure 14A:
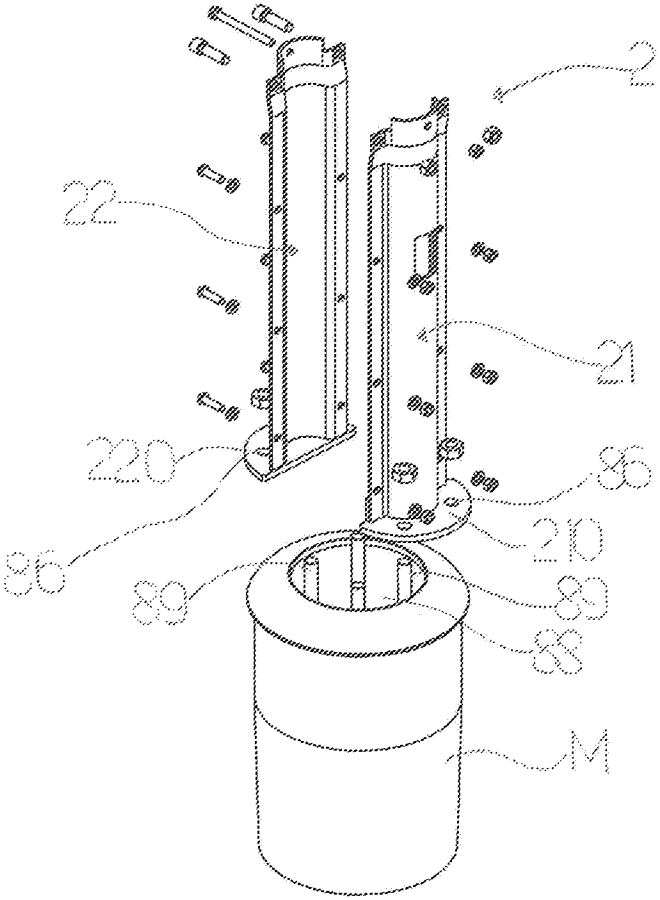
FIG. 14A illustrates, in an exploded view, particularly significant components of the road safety barrier of the invention, utilisable both for the assembly of the third preferred embodiment of FIG. 7 and for the fourth preferred embodiment of FIG. 9, or for the embodiment of FIG. 13.

FIGS. 14A and 14B illustrate a possible way in which the vertical support elements (2) can be coupled to concrete sleeves (M). The sleeves (M) have, at the top thereof, a seat (8) from which threaded bars (89) project, while the first vertical support member (21) and the second vertical support member (22) of the vertical support members (22) comprise, at the lower ends thereof, relative anchoring plates (210, 220) having half-moon shapes. The anchoring plates (210, 220) having a half-moon shape are further provided with through-holes (89) and are destined to be positioned, flanked to one another, and to insert internally of the seats (8) of the sleeves (M) in such a way that the threaded bars (89) cross the relative through-holes (86). For the reciprocal blocking and fixing of the two vertical support members of the vertical support members (22) to the sleeves (M), lock-nuts (87) are used, and screwed on the threaded bars (89).

The barrier (100) can also be conceived in such a way that the vertical support elements (2) and the vertical supplementary support elements (4) are directly lodged in the ground.

Figure 15:
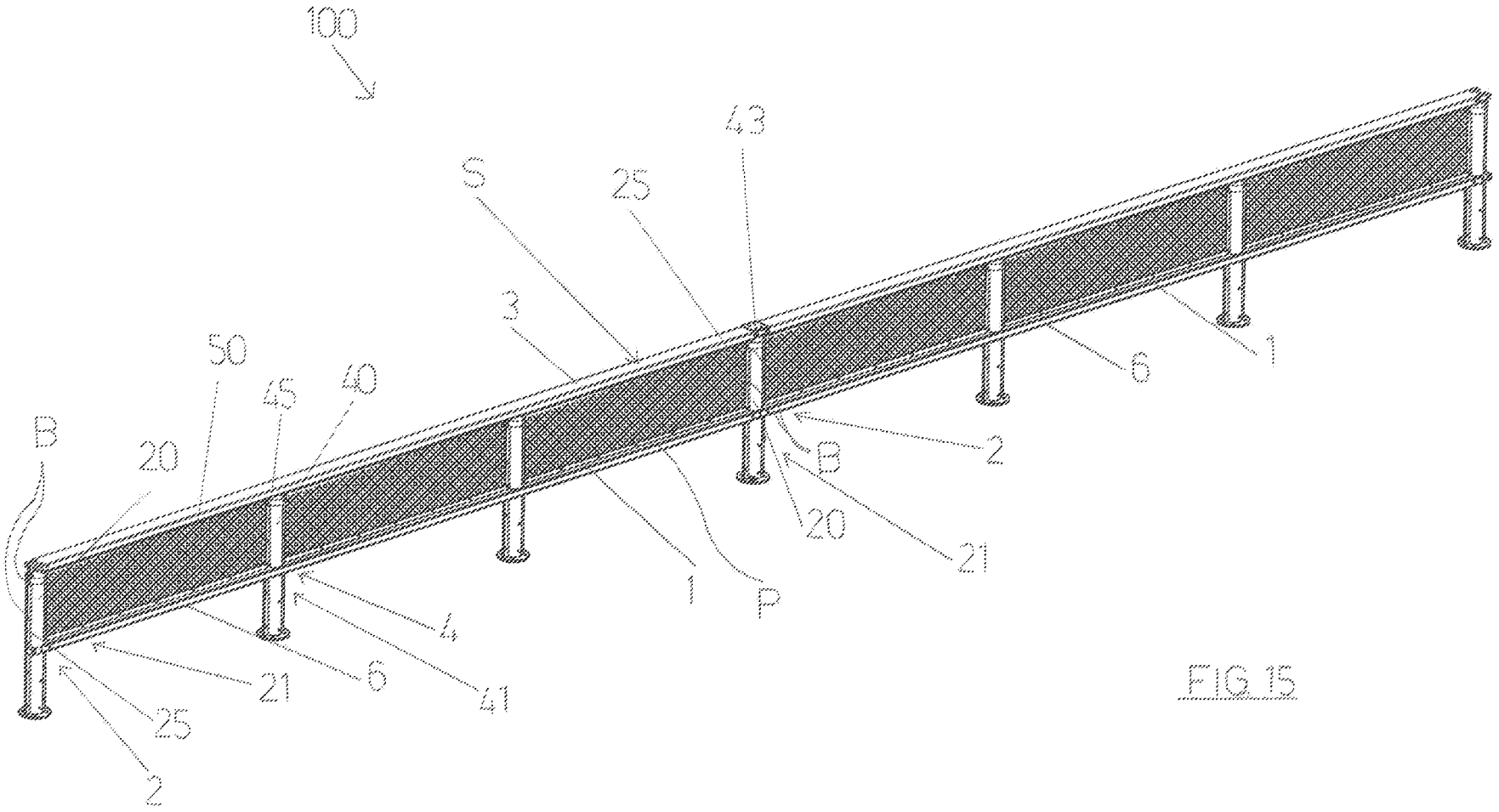
FIG. 15 is a schematic perspective view of the road safety barrier of the present invention, in a other preferred embodiment thereof.

With particular reference to FIG. 15, each of the panels (P) can comprise an external frame and a main body (50) which defines a mesh and which is surrounded by the external frame.

The panels (P) can be arranged flanked to one another at the relative external frames and the blocking means (B) can be conformed for crossing the relative external frames of the panels (P) and the flat portions (25) of the first vertical support member (21) and the second vertical support member (22).

The external frame and the main body (50) can be made of a ductile metal material, preferably made of aluminium or steel.

In this embodiment, the blocking means (B), crossing the relative external frames of the panels (P) and the flat portions (25) of the first vertical support member (21) and the second vertical support member (22), block the first vertical support member (21) and the second vertical support member (22) of each of the vertical support elements (2) to the panels (P).

The invention claimed is:

1. A road safety barrier, comprising:

a plurality of containing elements for absorbing an impact by a vehicle;

a plurality of vertical support elements for bearing the plurality of containing elements;

wherein:

the containing elements are constituted by panels arranged flanked to one another at respective vertical lateral edges in such a way that respective two faces form respective continuous flat surfaces, with each of the panels being made of a material that is deformable consequent upon an impact by a vehicle, so as to absorb kinetic energy generated by the impact, each of the vertical support elements comprises a first vertical support member and a second vertical support member arranged facing one another at the flanked vertical lateral edges of the panels, on opposite sides with respect to the two faces of the panels, the first vertical support member and the second vertical support member of each of the vertical support elements being conformed in such a way as to have flat portions for coupling with the faces of the panels and with at least one from between the first vertical support member and the second vertical support member being conformed in such a way as to have a main portion, between the two flat portions, having a cavity along a respective vertical extension or dimension, blocking means, conformed for crossing the panels and the flat portions of the first vertical support member and the second vertical support member, for the reciprocal blocking of the first vertical support member and the second vertical support member of each of the vertical support elements to the two opposite faces of the panels at the respective vertical lateral edges, longitudinal stiffening elements which are coupled to the panels at the respective upper longitudinal edges.

2. The road safety barrier of claim 1, wherein the main portion of the first vertical support member and/or of the second vertical support member is conformed so as to have a quadrangular, square or rectangular, transversal section shape or a semi-circular transversal section shape so as to identify a cavity internally thereof which extends along the respective vertical extension or dimension.

3. The road safety barrier of claim 1, further comprising vertical supplementary support elements which are coupled to the panels, in an intermediate position between two vertical support elements.

4. The road safety barrier of claim 3, wherein the vertical supplementary support elements comprise a first vertical supplementary support member and a second vertical supplementary support member arranged facing one another on opposite sides with respect to the two faces of the panels, the first vertical supplementary support member and the second vertical supplementary support member of each of the vertical supplementary support elements being conformed in such a way as to have flat portions for coupling with the faces of the panels and with at least one from between the first vertical supplementary support member and the second vertical supplementary support member being conformed in such a way as to have a main portion, between the two flat portions, having a cavity along the respective vertical extension or dimension.

5. The road safety barrier of claim 1, wherein the longitudinal stiffening elements have a shape such as to have a longitudinal groove having a shape and dimensions such as to be able to accommodate internally thereof a portion of the upper longitudinal edge of the panels and enable coupling thereof to the panels.

6. The road safety barrier of claim 5, wherein the longitudinal stiffening elements have a shape that is such as to exhibit a pair of longitudinal walls identifying between them a longitudinal groove arranged at a reciprocal distance in such a way that they are destined to contact portions of the two faces of the panels when the longitudinal stiffening elements are coupled to the upper longitudinal edges of the panels by means of the respective longitudinal groove, and wherein fastening means are provided to cross the longitudinal walls of the longitudinal stiffening elements and the panels for blocking the longitudinal stiffening elements to the panels.

7. The road safety barrier of claim 1, wherein the longitudinal stiffening elements are coupled to the panels at upper longitudinal edges of the panels consecutively and flanked to one another to form an upper continuous stiffening strip for the road barrier.

8. The road safety barrier of claim 7, further comprising connecting joints, couplable and fixable at flanking points between the longitudinal stiffening elements.

9. The road safety barrier of claim 1, further comprising vertical stiffening elements which are arranged and coupled to the panels at the respective vertical edges flanked to one another, in such a way as to be interposed between the faces of the panels and the first and second vertical support members of the vertical support elements.

10. The road safety barrier of claim 1, further comprising longitudinal reinforcing elements couplable to the panels along the respective lower longitudinal edges, the longitudinal reinforcing elements having a shape such as to exhibit a longitudinal groove having a shape and dimensions such as to be coupled to the lower longitudinal edge of the panels and a pair of longitudinal tabs identifying between them the longitudinal groove and arranged at a reciprocal distance such that they are destined to contact portions of the two faces of the panels when the longitudinal reinforcing elements are coupled to the lower longitudinal edges of the panels by means of the respective longitudinal groove, and wherein fastening means are provided to cross the longitudinal tabs of the longitudinal reinforcing elements and the panels for blocking the longitudinal reinforcing elements to the panels.

11. The road safety barrier of claim 1, wherein the panels are made of a plastically-deformable thermoplastic material or made of a ductile metal material.

12. The road safety barrier of claim 1, wherein the vertical support elements, the longitudinal stiffening elements, the vertical supplementary support elements, the vertical stiffening elements, the longitudinal reinforcing elements are made of a metal material.

13. The road safety barrier of claim 1, wherein the vertical support elements and/or the vertical supplementary support elements are directly lodged in the ground, or by means of concrete sleeves.

14. The road safety barrier of claim 1, wherein: each of the panels comprises an external frame and a main body which defines a mesh and which is surrounded by the external frame; the panels are arranged flanked to one another at the respective external frames; the blocking means are conformed for crossing the respective external frames of the panels and the flat portions of the first vertical support member and the second vertical support member.

* * * * *